US006369790B1

(12) United States Patent
Hidaka

(10) Patent No.: US 6,369,790 B1
(45) Date of Patent: Apr. 9, 2002

(54) LIQUID CRYSTAL DRIVING CIRCUIT AND LIQUID CRYSTAL DISPLAY SYSTEM

(75) Inventor: Kiyoshi Hidaka, Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/289,962

(22) Filed: Apr. 13, 1999

(30) Foreign Application Priority Data

Apr. 17, 1998 (JP) ..... 10-107901

(51) Int. Cl.[7] ..... G09G 3/36

(52) U.S. Cl. ..... 345/98; 345/100; 345/211

(58) Field of Search ..... 345/98, 100, 87–90, 345/92, 94, 96, 204, 211–213, 99, 545, 547, 559

(56) References Cited

U.S. PATENT DOCUMENTS

| | | | | |
|---|---|---|---|---|
| 5,420,604 A | * | 5/1995 | Scheffer et al. | 345/100 |
| 5,670,973 A | * | 9/1997 | Bassetti, Jr. et al. | 345/58 |
| 5,900,856 A | * | 5/1999 | Iino et al. | 345/100 |
| 5,953,002 A | * | 9/1999 | Hirai et al. | 345/204 |
| 6,191,768 B1 | * | 2/2001 | Imamura | 345/98 |
| 6,252,572 B1 | * | 6/2001 | Kurumisawa et al. | 345/98 |

FOREIGN PATENT DOCUMENTS

| | | |
|---|---|---|
| JP | 60-17790 | 1/1985 |
| WO | WO 96/16346 | 5/1996 |

* cited by examiner

*Primary Examiner*—Richard Hjerpe
*Assistant Examiner*—Frances Nguyen
(74) *Attorney, Agent, or Firm*—Oblon, Spivak, McClelland, Maier & Neustadt, P.C.

(57) ABSTRACT

A segment electrode driving circuit of a liquid crystal driving circuit comprises: data storing means for storing therein k+1 values in accordance with the k function values and $2^k$ k-bit data and for simultaneously outputting $2^k$ values on the basis of the alternating signal and a field select signal; $2^k$ power supply lines provided so as to correspond to $2^k$ outputs of the data storing means; a first analog multiplexer for connecting each of the $2^k$ power supply lines to one of k+1 power supplies, each of which has a potential different from each other, on the basis of a corresponding one of the $2^k$ outputs of the data storing means corresponding to a corresponding one of the $2^k$ power supply lines; and a second analog multiplexer, provided for each of segment electrodes, for receiving k display data corresponding to the selected k common electrodes from the RAM for display data, and for selecting one of the $2^k$ power supply lines on the basis of the k display data to connect the selected one of the $2^k$ power supply lines to a corresponding one of the segment electrodes. Thus, it is possible to prevent the manufacturing costs from increasing.

12 Claims, 17 Drawing Sheets

| ALT | | 0 | | | | 1 | | | |
|---|---|---|---|---|---|---|---|---|---|
| FS1 | | 0 | | 1 | | 0 | | 1 | |
| FS0 | | 0 | 1 | 0 | 1 | 0 | 1 | 0 | 1 |
| APPLIED VOLTAGE | 0000 | 4 | 2 | 2 | 2 | 0 | 2 | 2 | 2 |
| | 1000 | 3 | 1 | 1 | 1 | 1 | 3 | 3 | 3 |
| | 0100 | 3 | 3 | 1 | 3 | 1 | 1 | 3 | 1 |
| | 1100 | 2 | 2 | 0 | 2 | 2 | 2 | 4 | 2 |
| | 0010 | 3 | 1 | 3 | 3 | 1 | 3 | 1 | 1 |
| | 1010 | 2 | 0 | 2 | 2 | 2 | 4 | 2 | 2 |
| | 0110 | 2 | 2 | 2 | 4 | 2 | 2 | 2 | 0 |
| | 1110 | 1 | 1 | 1 | 3 | 3 | 3 | 3 | 1 |
| | 0001 | 3 | 3 | 3 | 1 | 1 | 1 | 1 | 3 |
| | 1001 | 2 | 2 | 2 | 0 | 2 | 2 | 2 | 4 |
| | 0101 | 2 | 4 | 2 | 2 | 2 | 0 | 2 | 2 |
| | 1101 | 1 | 3 | 1 | 1 | 3 | 1 | 3 | 3 |
| | 0011 | 2 | 2 | 4 | 2 | 2 | 2 | 0 | 2 |
| | 1011 | 1 | 1 | 3 | 1 | 3 | 3 | 1 | 3 |
| | 0111 | 1 | 3 | 3 | 3 | 3 | 1 | 1 | 1 |
| | 1111 | 0 | 2 | 2 | 2 | 4 | 2 | 2 | 2 |
| | | $4_1$ | $4_2$ | $4_3$ | $4_4$ | $5_1$ | $5_2$ | $5_3$ | $5_4$ |

4 : Vo
3 : Vo/2
2 : 0
1 : −Vo/2
0 : −Vo

FIG. 2

| ALT | | 0 | | | | 1 | | | |
|---|---|---|---|---|---|---|---|---|---|
| FS1 | | 0 | | 1 | | 0 | | 1 | |
| FS0 | | 0 | 1 | 0 | 1 | 0 | 1 | 0 | 1 |
| FUNCTION | FD0 | 1 | 1 | 1 | 1 | 0 | 0 | 0 | 0 |
| | FD1 | 1 | 0 | 1 | 0 | 0 | 1 | 0 | 1 |
| | FD2 | 1 | 1 | 0 | 0 | 0 | 0 | 1 | 1 |
| | FD3 | 1 | 0 | 0 | 1 | 0 | 1 | 1 | 0 |
| | | $6_1$ | $6_2$ | $6_3$ | $6_4$ | $7_1$ | $7_2$ | $7_3$ | $7_4$ |

FIG. 11

PRIOR ART

LIQUID CRYSTAL DRIVING CIRCUIT AND LIQUID CRYSTAL DISPLAY SYSTEM

BACKGROUND OF THE INVENTION

1. Field of the Invention

The present invention relates to a liquid crystal driving circuit for driving a liquid crystal display system by the multi-line selection (MLS) method, and a liquid crystal display system driven by the liquid crystal driving circuit.

2. Related Background Art

In recent years, liquid crystal display systems are widely noticed as light flat panel displays of low electric power consumption. As one of methods for driving such liquid crystal display systems, the MLS method for simultaneously selecting a plurality of scanning lines, i.e., a plurality of common electrodes connected to the scanning lines, is known. Referring to FIGS. 9 through 16, a conventional liquid crystal display system driven by the MLS method will be described.

FIG. 9 is a block diagram showing a typical construction of a liquid crystal display system driven by the MLS method. As shown in FIG. 9, the liquid crystal display system driven by the MLS method comprises a liquid crystal display part 2, a common electrode driving circuit 10, a segment electrode driving circuit 30, a function generating part 50, and a random access memory (RAM) 70 for display data.

The liquid crystal display part 2 comprises: a first transparent substrate, on which a plurality of common electrodes are arranged in parallel to each other; a second transparent substrate, on which a plurality of segment electrodes are arranged in parallel to each other, the second transparent substrate facing the first transparent substrate so that the segment electrodes intersect the common electrodes; and a liquid crystal layer sandwiched between the first and second transparent substrates. Each of the common electrodes is connected to a corresponding one of different scanning lines COMi (i=1, . . . , m), and each of the segment electrodes is connected to a corresponding one of different signal lines SEGj (j=1, . . . , n).

The common electrode driving circuit 10 is designed to simultaneously select a plurality of scanning lines to drive the common electrodes connected to the selected scanning lines.

FIG. 10 shows the details of the common electrode driving circuit 10 and the function generating part 50. The common electrode driving circuit 10 is designed to simultaneously select four scanning lines. The common electrode driving circuit 10 comprises: a shift register 11; a plurality of logic parts 13, each of which is provided for each scanning line COMi (i=1, . . . , m); and a plurality of sets of three analog switches 15, 16 and 17, each set of which is provided for each scanning line COMi (i=1, . . . , m). The function generating part 50 has a 2-bit binary counter 51 and a function generator circuit 55.

The 2-bit binary counter 51 is designed to operate in response to a field start signal and count the pulse number of the field start signal in synchronism with a shift clock to transmit counted values FS1 and FS0 to the function generator circuit 55. The FS0 and FS1 are indicative of the low-order bits and high-order bits of the counted values, respectively, and also called field select signals.

The function generator circuit 55 is designed to generate 4-bit values FD0, FD1, FD2 and FD3, which correspond to an alternating signal ALT and the output signals FS1 and FS0 of the 2-bit binary counter 51, on the basis of these signals. For example, as shown in FIG. 11, when ALT="0", FS1="0" and FS0="0", then FD0=FD1=FD2=FD3="1", i.e., values shown in a column $\mathbf{6}_1$ are generated, and when ALT="0", FS1="0" and FS0="1", then FD0=FD2="1" and FD1=FD3="0", i.e., values shown in a column $\mathbf{6}_2$ are generated.

Furthermore, the functions FD0, FD1, FD2 and FD3 shown in FIG. 11 are called Hadamard functions. The column $\mathbf{6}_1$ is used for selecting a first field which forms one frame, and the column $\mathbf{6}_2$ is used for selecting a second field. In addition, a column $\mathbf{6}_3$ is used for selecting a third field, and a column $\mathbf{6}_4$ is used for selecting a fourth field. Moreover, columns $\mathbf{7}_i$ (i=1, . . . , 4) are formed by inverting the respective values of the column $\mathbf{6}_i$. The column $\mathbf{7}_1$ is used for selecting the first field, and the column $\mathbf{7}_2$ is used for selecting the second field. The column $\mathbf{7}_3$ is used for selecting the third field, and the column $\mathbf{7}_4$ is used for selecting the fourth field. The use of these columns $\mathbf{7}_1$ through $\mathbf{7}_4$ prevents charges from being stored in the liquid crystal layer.

On the other hand, the shift register 11 of the common electrode driving circuit 10 is designed to sequentially select the first through fourth fields on the basis of a field start signal, and simultaneously select four successive scanning lines on the basis of a shift clock signal in each of the selected fields to sequentially carry out the simultaneous selection. For example, as shown in FIG. 12, when the shift register 11 receives a first field start signal, a first field is selected. Thereafter, when the shift register 11 receives a shift clock, the shift register 11 outputs a signal OA for simultaneously selecting scanning lines COM1 through COM4. Then, on the basis of the next shift clock, the shift register 11 outputs a signal OB for simultaneously selecting scanning lines COM 5 through COM8. Thus, the operations for simultaneously selecting four successive scanning lines within a selection period for the first field are sequentially carried out.

Each of the logic parts 13 comprises two inverter gates and two AND gates. The logic part 13 corresponding to the scanning line COM1 is designed to select one analog switch, which is connected to the scanning line COM1 and which is one of the three analog switches 15, 16 and 17, on the basis of the output signal OA of the shift register 11 and the output FD0 of the function generator circuit 55. The logic part 13 corresponding to the scanning line COM2 is designed to select one analog switch, which is connected to the scanning line COM2 and which is one of the three analog switches 15, 16 and 17, on the basis of the output signal OA of the shift register 11 and the output FD1 of the function generator circuit 55.

The logic part 13 corresponding to the scanning line COM3 is designed to select one analog switch, which is connected to the scanning line COM3 and which is one of the three analog switches 15, 16 and 17, on the basis of the output signal OA of the shift register 11 and the output FD2 of the function generator circuit 55. The logic part 13 corresponding to the scanning line COM4 is designed to select one analog switch, which is connected to the scanning line COM4 and which is one of the three analog switches 15, 16 and 17, on the basis of the output signal OA of the shift register 11 and the output FD3 of the function generator circuit 55.

Similarly, each of the logic parts 13 corresponding to the scanning lines COM5 through COM8 is designed to select one analog switch, which is connected to the corresponding scanning line and which is one of the three analog switches 15, 16 and 17, on the basis of the output signal OB of the shift register 11 and the output of the function generator circuit 55.

Each of the analog switches 15, 16 and 17 is designed to supply a voltage Vr (≠0), 0 or −Vr to the corresponding scanning lines when it is selected by the corresponding logic part 13.

Therefore, as shown in FIG. 12, when the first field is selected, if the signal OA is outputted from the shift register 11 (OA="1"), the voltage Vr is supplied to the scanning lines COM1, COM2, COM3 and COM4, so that the voltage Vr is applied to the common electrodes connected to the scanning lines COM1, COM2, COM3 and COM4. Furthermore, when the signal OA is not outputted, voltage 0 is supplied to these scanning lines. In addition, when the second field is selected, if the output signal OA is outputted from the shift register 11, the voltage Vr is supplied to the scanning lines COM1 and COM3, and the voltage −Vr is supplied to the scanning lines COM2 and COM4.

Thus, after the first through fourth fields are sequentially selected, the first through fourth fields are sequentially selected on the basis of, e.g., the column $\mathbf{7}_1$ through $\mathbf{7}_4$ shown in FIG. 11.

FIG. 13 shows the details of the conventional segment electrode driving circuit 30. The conventional segment electrode driving circuit 30 has a latch circuit $\mathbf{40}_i$, an arithmetic circuit $\mathbf{90}_i$, and a switch circuit $\mathbf{93}_i$ comprising five analog switches 93*a* through 93*e*, for each signal line SEGi (i=1, . . . , n). Each of the latch circuits $\mathbf{40}_i$ has two registers 41 and 42 as shown in FIG. 14.

The RAM 70 for display data stores therein data displayed on the liquid crystal display part. Each of the latch circuits $\mathbf{40}_i$ (i=1, . . . n) receives 4-bit data DD0, DD1, DD2 and DD3, which are to be transmitted to the corresponding signal lines SEGi, from the RAM 70 for display data to latch the data. These 4-bit data DD0, DD1, DD2 and DD3 are serially transmitted from the RAM 70 for display data. Thereafter, these data are transferred from the register 41 to the register 42 in parallel to be held therein. The 4-bit data DD0, DD1, DD2 and DD3 held in the register 42 of each of the latch circuits $\mathbf{40}_i$ (i=1, . . . , n) are transferred to the corresponding arithmetic circuit $\mathbf{90}_i$ at a predetermined timing. Furthermore, the data DD0 is a value displayed on a pixel corresponding to a common electrode connected to a scanning line COMj which is one of the simultaneously selected four scanning lines COMj (j=1, . . . , m), COMj+1, COMj+2 and COMj+3, and the data DD1 is a value displayed on a pixel corresponding to a common electrode connected to the scanning line COMj+1. The data DD2 is a value displayed on a pixel corresponding to a common electrode connected to the scanning line COMj+2, and the data DD3 is a value displayed on a pixel corresponding to a common electrode connected to the scanning line COMj+3. Each of the data DDi (i=0, 1, 2, 3) represents "1" when the corresponding pixel is ON, and "0" when it is OFF.

Each of the arithmetic circuits $\mathbf{90}_i$ (i=1, . . . , n) is designed to operate a value I, i.e., I=DD0@FD0+DD1@FD1+DD2@FD2+DD3@FD3, on the basis of the 4-bit data transferred from the corresponding latch circuit $\mathbf{40}_i$, and the outputs FD0, FD1, FD2 and FD3 of the function generator circuit 55, and output a selection signal for selecting one of the five analog switches 93*a* through 93*e* of the corresponding switch circuit $\mathbf{93}_i$. Furthermore, the symbol @ means an operation symbol indicative of an exclusive OR. FIG. 15 shows an example of the arithmetic circuit $\mathbf{90}_i$ (i=1, . . . , n).

As shown in FIG. 15, each of the arithmetic circuits $\mathbf{90}_i$ has four exclusive OR gates 92, a full adder 93, half-adders 94 and 95, and a decoder 100 which comprises three inverter gates 96, three inverter gates 97, five NAND gates 98 and five inverter gates 99.

When the value I is "0", the analog switch 93*a* is selected, and when the value I is "1", the analog switch 93*b* is selected. When the value I is is "2", the analog switch 93*c* is selected, and when the value I is "3", the analog switch 93*d* is selected. When the value I is "4", the analog switch 93*e* is selected.

Each of the switch circuits $\mathbf{90}_i$ (i=1, . . . , n) is designed to supply a voltage of $-V_0$ ($V_0 \neq 0$) volts when the analog switch 93*a* is selected, a voltage of $-V_0/2$ volts when the analog switch 93*b* is selected, a voltage of 0 volt when the analog switch 93*c* is selected, a voltage $V_0/2$ volts when the analog switch 93*d* is selected, and a voltage of $V_0$ volts when the analog switch 93*e* is selected.

FIG. 16 shows a conventional RAM 70 for display data. The conventional RAM 70 for display data comprises a cell array 71 comprising a plurality of RAM cells 72 arranged in the form of a matrix, an address decoder 75, a display data read counter and decoder 77, an I/F control circuit 80, a data I/O circuit 82, and an oscillator circuit 85. Each of the RAM cells 72 comprises two transistors, a latch circuit comprising two inverter gates, and a three-state driver.

In the conventional RAM 70, when data are read out of or written in the cell array 71, one of selection signals is usually selected by the address decoder 75 to read or write data. However, when data are read out to be transferred to the latch circuit 40, the following operations are carried out. First, a clock is generated from the oscillator circuit 85. On the basis of this clock, selection signals are sequentially outputted from the display data read counter 77 at four times. Then, data are read out of the corresponding RAM cell 72 by each of the selection signals. The read data are serially transmitted to the latch circuits $\mathbf{40}_1$, . . . , $\mathbf{40}_n$. Furthermore, each of the latch circuits $\mathbf{40}_i$ (i=1, . . . , n) is designed to sequentially hold data, which have been read out of the RAM cells 72 by a shift signal transmitted from the display data read counter 77, in the first register 41. The 4-bit data are held in the second register 42 at a time by a latch enable signal transmitted from the display data read counter 77 when all of 4-bit data are held.

Thus, the conventional liquid crystal display system has one arithmetic circuit $\mathbf{90}_i$ for each of the signal lines SEGi (i=1, . . . , n). The number n of signal lines SEG1 through SEGn is generally 100 or more. In addition, since each of the arithmetic circuits is formed as shown in FIG. 15, the number of elements (transistors) is large (e.g., about 230). Therefore, there are problems in that the chip size is large, and the yields of products deteriorate to increase the manufacturing costs.

In addition, in the conventional RAM for display data, it is required to quickly read display data four times, so that there is a problem in that electric power consumption increases.

SUMMARY OF THE INVENTION

It is therefore an object of the present invention to eliminate the aforementioned problems and to provide a liquid crystal display system capable of preventing the manufacturing costs from increasing.

In order to accomplish the aforementioned and other objects, according to one aspect of the present invention, a liquid crystal driving circuit comprises: a function generating part for generating k (≧2) kinds of function values for k fields on the basis of a field start signal, a shift clock and an alternating signal; a common electrode driving circuit for simultaneously selecting k common electrodes on the basis of the field start signal and the shift clock and for applying a plurality of kinds of common voltages to the selected k common electrodes; a RAM for display data, in which data to be displayed on a liquid display part are stored; and a segment electrode driving circuit including: data storing means for storing therein k+1 values in accordance with the k function values and $2^k$ k-bit data and for simultaneously outputting $2^k$ values on the basis of the alternating signal and a field select signal; $2^k$ power supply lines provided so as to correspond to $2^k$ outputs of the data storing means; a first analog multiplexer for connecting each of the $2^k$ power supply lines to one of k+1 power supplies, each of which has a potential different from each other, on the basis of a corresponding one of the $2^k$ outputs of the data storing means corresponding to a corresponding one of the $2^k$ power supply lines; and a second analog multiplexer, provided for each of segment electrodes, for receiving k display data corresponding to the selected k common electrodes from the RAM for display data, and for selecting one of the $2^k$ power supply lines on the basis of the k display data to connect the selected one of the $2^k$ power supply lines to a corresponding one of the segment electrodes.

The first analog multiplexer may comprise: a decoder circuit for decoding each of the $2^k$ outputs of the data storing means; and a switching part, provided for each of outputs of the decoder circuits, for connecting a corresponding one of the $2^k$ power supply lines to one of the k+1 power supplies on the basis of a corresponding one of the $2^k$ outputs of the data storing means.

The second analog multiplexer may comprise: decoder means for decoding the k display data received from the RAM for display data, as k-bit data; and a switching part for selecting one of the $2^k$ power supply lines on the basis of an output of the decoder means to connect the selected one of the $2^k$ power supply lines to a corresponding one of the segment electrodes.

The data storing means may be a data table.

The data storing means may have a first RAM, and the function generating part may have a second RAM, in which the function values are stored.

The common electrode driving circuit may be operated so as to sequentially shift the simultaneously selected k common electrodes, and the function generating part may further comprise field changing means for changing a field of a generated function every time the simultaneously selected k common electrodes are shifted.

The RAM for display data serially may output k display data which are to be transmitted to each of the segment electrodes, and the segment electrode driving circuit may further comprise latch circuits, each of which is provided for each of the segment electrodes and each of which comprises a first register for serially receiving k display data, which are to be transmitted to a corresponding one of the segment electrodes, from the RAM for display data, and a second register for receiving and latching, in parallel, the k display data, which are stored in the first register, to supply the latched display data to the second analog multiplexer.

The RAM for display data may output, in parallel, k display data, which are to be transmitted to each of the segment electrodes, and the segment electrode driving circuit may further comprise latch circuits, each of which is provided for each of the segment electrodes for latching k display data which are read out of the RAM for display data in parallel.

According to another aspect of the present invention, a liquid crystal driving circuit comprises: a function generating part for generating k (≧2) kinds of function values for k fields on the basis of a field start signal, a shift clock and an alternating signal; a common electrode driving circuit for simultaneously selecting k common electrodes on the basis of the field start signal and the shift clock and for applying a plurality of kinds of common voltages to the selected k common electrodes; a RAM for display data, in which data to be displayed on a liquid display part are stored; an arithmetic circuit including: k+1 power supply lines, to each of which a voltage different from each other is supplied; and a counter circuit, provided for each of segment electrodes, for receiving k display data corresponding to the k common electrodes, one by one, in synchronism with a predetermined clock and for receiving the k function values outputted from the function generating part, one by one, in synchronism with the predetermined clock to be operated in accordance with an exclusive OR of the k display data and the k function values in synchronism with the predetermined clock; and a segment electrode driving circuit having an analog multiplexer, provided for each of the segment electrodes, for selecting one of the k+1 power supply lines on the basis of an output of the arithmetic circuit and for connecting the selected one of the k+1 power supply lines to a corresponding one of the segment electrodes.

The analog multiplexer may comprise: decoder means for decoding a value received from the arithmetic circuit; and a switching part for selecting one of the power supply lines on the basis of an output of the decoder means to connect the selected one of the power supply lines to a corresponding one of the segment electrodes.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings:

FIG. 2 is a table for explaining data held in a data table shown in FIG. 1;

FIG. 11 is a table showing function values generated by a function generator circuit shown in FIG. 10;

DESCRIPTION OF THE PREFERRED EMBODIMENTS

Figure 1:
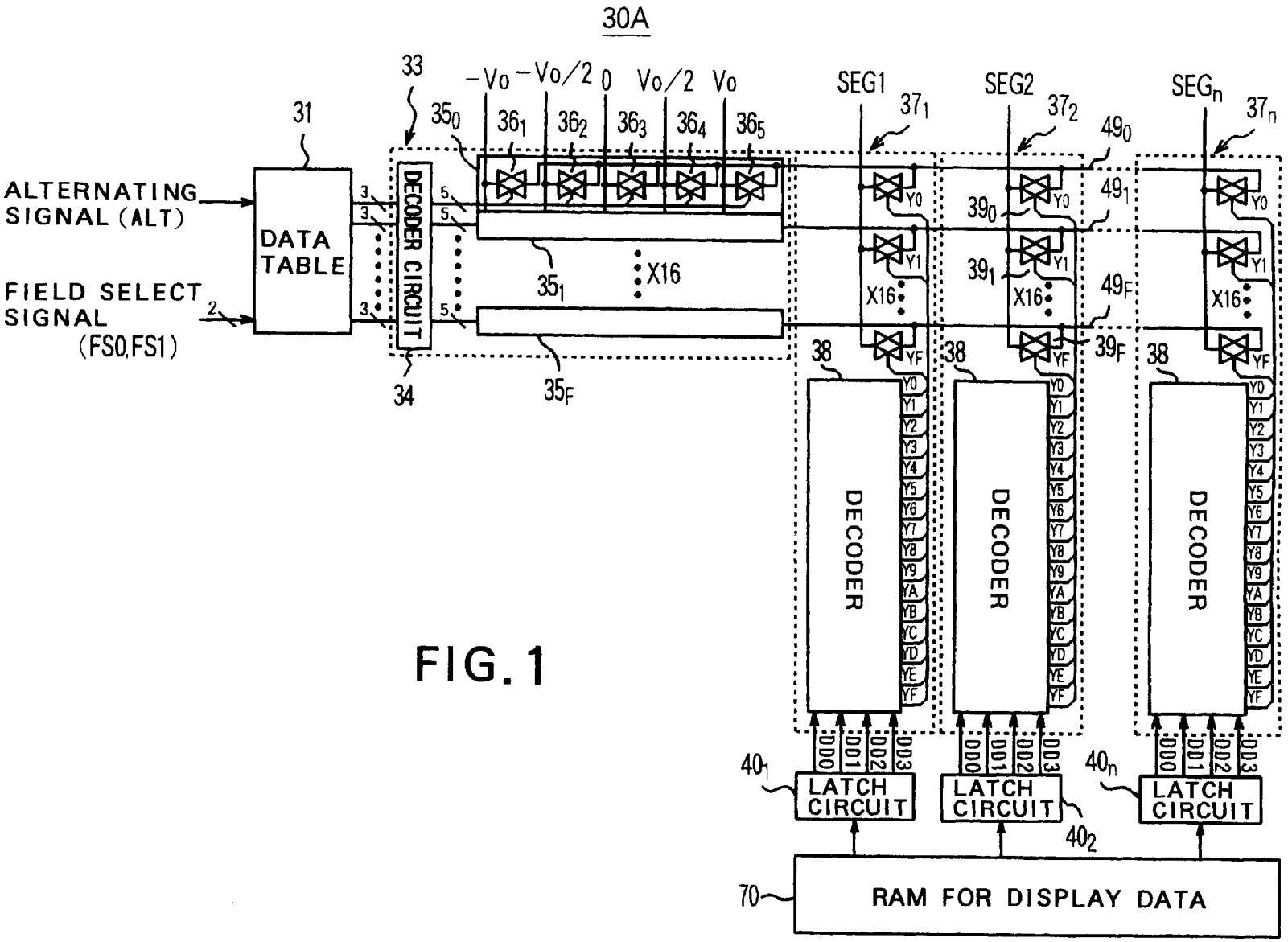
FIG. 1 is a block diagram of the first preferred embodiment of a segment electrode driving circuit according to the present invention.
Figure 17:
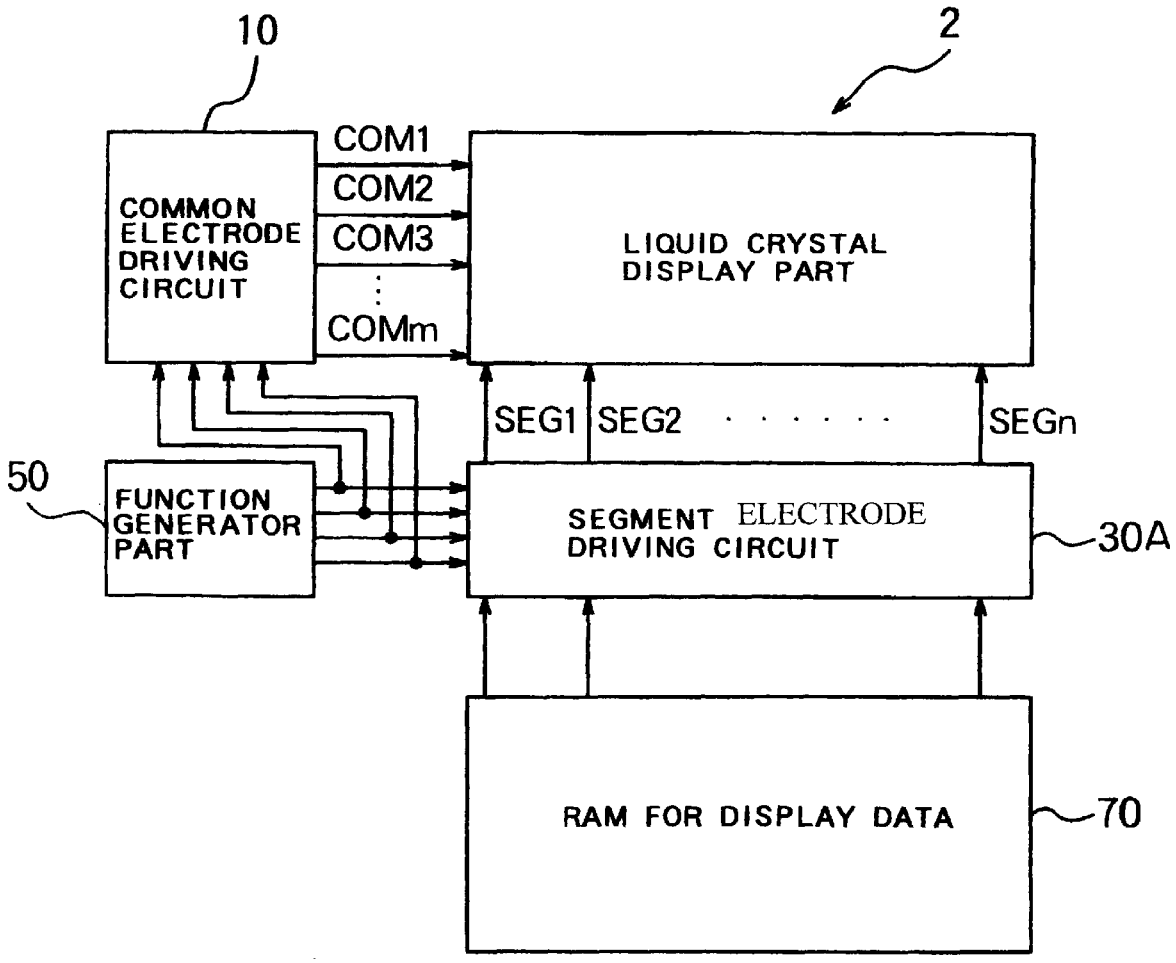
FIG. 17 is a block diagram of the first preferred embodiment of a liquid crystal display system according to the present invention.

Referring now to the accompanying drawings, particularly to FIGS. 1 through 4 and 17, the first preferred embodiment of a liquid crystal display system according to the present invention will be described below. FIG. 1 is a block diagram of the first preferred embodiment of a segment electrode driving circuit 30A of a liquid crystal display system according to the present invention. FIG. 17 is a block diagram of the first preferred embodiment of a liquid crystal display system according to the present invention.

Figure 9:
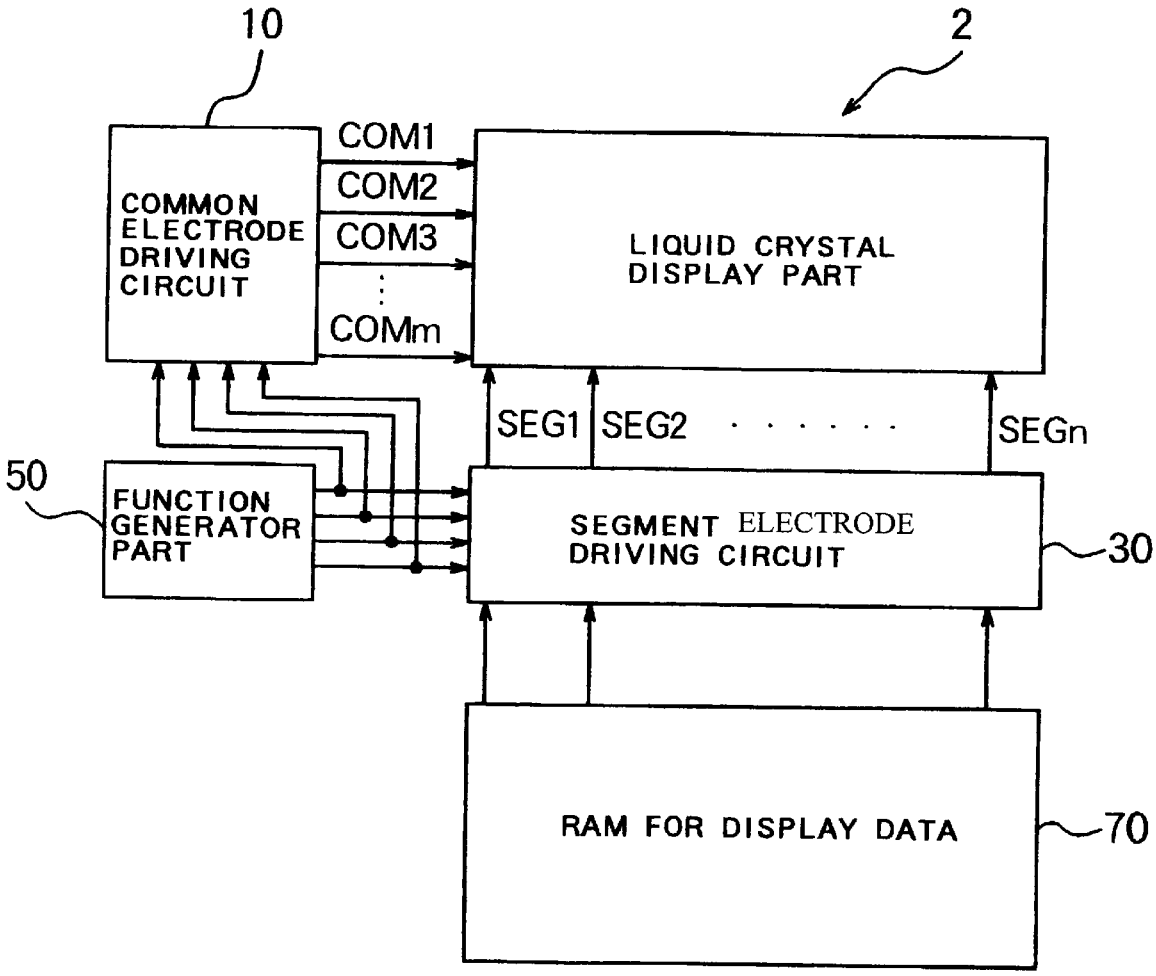
FIG.9 PRIOR ART
FIG. 9 is a block diagram of a liquid crystal display system driven by the MLS method.

In the first preferred embodiment, the liquid crystal display system uses the segment electrode driving circuit 30A of FIG. 1, in place of the segment electrode driving circuit 30 of the conventional liquid crystal display system of FIG. 9.

In the first preferred embodiment, the liquid crystal display system is driven by the MLS method. In this system, the number k of simultaneously selected scanning lines is 4.

As shown in FIG. 1, the segment electrode driving circuit 30A of the liquid crystal system in the first preferred embodiment comprises a data table 31, an analog multiplexer 33, analog multiplexers $\mathbf{37}_1, \ldots, \mathbf{37}_n$, and latch circuits $\mathbf{40}_1, \ldots, \mathbf{40}_n$.

The data table 31 has data of table columns $\mathbf{4}_1$ through $\mathbf{4}_4$ and $\mathbf{5}_1$ through $\mathbf{5}_4$ shown in FIG. 2. The data table 31 is designed to simultaneously output 16 data of one of the columns on the basis of an alternating signal ALT and field select signals FS0 and FS1. Furthermore, each of the data is stored in the data table 31 as 3-bit data. For example, when ALT=FS0=FS1="0", 16 data of the column $\mathbf{4}_1$, i.e., 4, 3, 3, 2, 3, 2, 2, 1, 3, 2, 2, 1, 2, 1, 1 and 0, are simultaneously outputted as 3-bit data, respectively. Therefore, the column $\mathbf{4}_1$ is used when the first field is selected, and the column $\mathbf{4}_2$ is used when the second field is selected. In addition, the column $\mathbf{4}_3$ is used when the third field is selected, and the column $\mathbf{4}_4$ is used when the fourth field is selected. Moreover, the columns $\mathbf{5}_1$, $\mathbf{5}_2$, $\mathbf{5}_3$ and $\mathbf{5}_4$ are used when the first, second, third and fourth fields are selected, respectively. Furthermore, 4-bit digits shown on the left side of the column $\mathbf{4}_1$ in FIG. 2 represent the respective values of 4-bit data DD0, DD1, DD2 and DD3 which are read out of the RAM 70 for display data.

The analog multiplexer 33 comprises a decoder circuit 34, and switching parts $\mathbf{35}_0, \ldots, \mathbf{35}_9, \mathbf{35}_A, \ldots, \mathbf{35}_F$ provided so as to correspond to 16 data transmitted from the data table 31. The decoder circuit 34 is designed to decode each of sixteen 3-bit data transmitted from the data table 31 to transmit the decoded result to the corresponding switching part $\mathbf{35}_i$ (i=0, . . . , 9, A, . . . , F).

Figure 3:
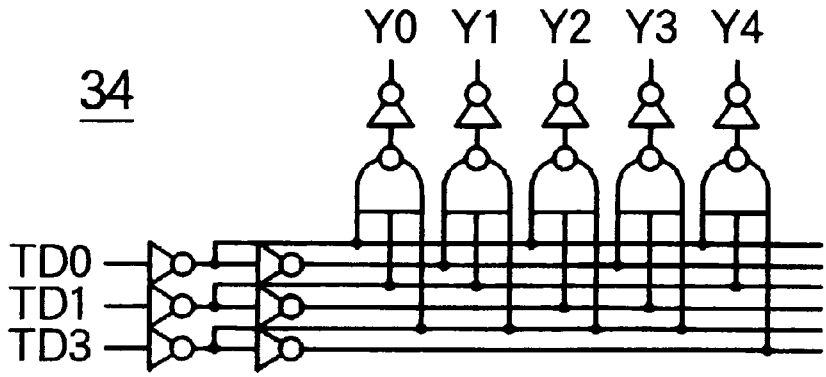
FIG. 3 is a circuit diagram of an example of a decoder for the segment electrode driving circuit of FIG. 1.

Referring to FIG. 3, an example of the decoder circuit 34 will be described. FIG. 3 is a circuit diagram of a decoder for decoding 3-bit data. The decoder circuit 34 has 16 decoders, one of which is shown in FIG. 3. The decoder has a first-stage logic gate comprising three inverter gates, a second-stage logic gate comprising three inverter gates, a third-stage logic gate comprising five NAND gates, and a fourth-stage logic gate comprising five inverter gates. Assuming that the least significant bit of 3-bit data transmitted from the data table 31 is TD0, the bit being higher than the least significant bit by a place is TD1, and the most significant bit thereof is TD2, then the 3-bit data are decoded, so that five output signals Y0, Y1, Y2, Y3 and Y4 are outputted from the fourth-stage logic gate. Only one of the five output signals Y0, Y1, Y2, Y3 and Y4 has a value of "1", and the remaining signals have a value of "0". For example, when the value of 3-bit data is "0" in the decimal number system, i.e., when TD0=TD1=TD2="0", then Y0="1" and Y1=Y2=Y3=Y4="0", and when the value of 3-bit data is "4" in the decimal number system, i.e., when TD0=TD1="0" and TD2="1", then Y0=Y1=Y2=Y3="0" and Y4="1".

Each of the switching parts $\mathbf{35}_i$ (i=0, . . . , 9, A, . . . , F) has five analog switches $\mathbf{36}_i, \ldots, \mathbf{36}_5$. In accordance with the values of the five signals Y0, Y1, Y2, Y3 and Y4 received from the decoder circuit 34, one of the five analog switches $\mathbf{36}_1, \ldots, \mathbf{36}_5$ is selected to be turned ON. For example, when Y0="1", and Y1=Y2=Y3=Y4="0" the analog switch $\mathbf{36}_1$ is selected to be turned ON, and when Y1="1" and Y0=Y2=Y3=Y4="0", the analog switch $\mathbf{36}_2$ is selected to be turned ON. In addition, when Y2="1" and Y0=Y1=Y3=Y4="0", the analog switch $\mathbf{36}_3$ is selected to be turned ON, and when Y3="1" and Y0=Y1=Y2=Y4="0", the analog switch $\mathbf{36}_4$ is selected to be turned ON. Moreover, when Y4="1" and Y0=Y1=Y2=Y3="0", the analog switch $\mathbf{36}_5$ is selected to be turned ON.

Each of the switching parts $\mathbf{35}_i$ (i=1, . . . , 9, A, . . . , F) is designed to output a voltage of $-V_0$ volts when the analog switch $\mathbf{36}_1$ is selected, a voltage of $-V_0/2$ volts when the analog switch $\mathbf{36}_2$ is selected, a voltage of 0 volt when the analog switch $\mathbf{36}_3$ is selected, a voltage of $V_0/2$ volts when the analog switch $\mathbf{36}_4$ is selected, and a voltage of $V_0$ volts when the analog switch $\mathbf{36}_5$ is selected.

On the other hand, the analog multiplexer $\mathbf{37}_i$ (i=1, . . . , n) corresponds to the latch circuit $\mathbf{40}_i$, and comprises a decoder 38 and 16 analog switches $\mathbf{39}_0, \ldots, \mathbf{39}_9, \mathbf{39}_A, \ldots, \mathbf{39}_F$. Furthermore, the latch circuit $\mathbf{40}_i$ (i=1, . . . , n) has the same construction as that described in the prior art.

Figure 4:
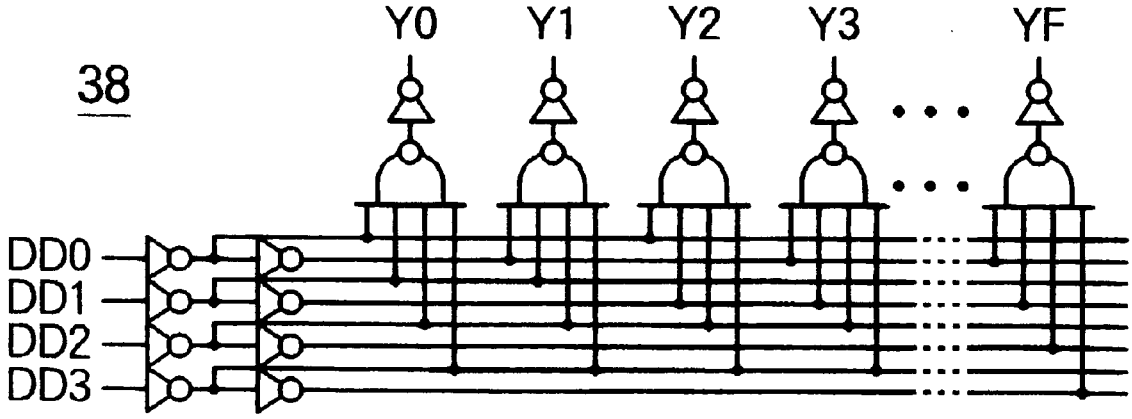
FIG. 4 is a circuit diagram of an example of a decoder for the segment electrode driving circuit of FIG. 1.

The decoder 38 of each analog multiplexer $\mathbf{37}_i$ (i=1, . . . , n) is designed to decode 4-bit data DD0, DD1, DD2 and DD3 outputted from the corresponding latch circuit $\mathbf{40}_i$ to activate and output only one of the 16 signals Y0 through YF as decoded results. Only the activated signal has a value of "1", and the remaining signals have a value of "0". For example, as shown in FIG. 4, the decoder 38 has a first-stage logic gate comprising four inverter gates, a second-stage logic gate comprising four inverter gates, a third-stage logic gate comprising 16 NAND gates, and a fourth-stage logic gate comprising 16 inverter gates.

On the basis of the output signal Yj of the decoder 38, the analog switch $\mathbf{39}_j$ (j=0, . . . , 9, A, . . . , F) is turned ON to supply a voltage, which is supplied to a power supply line $49_j$ via a switching part $35_j$, to a signal line corresponding to an analog multiplexer, to which the analog switch $39_j$ belongs. For example, when the analog switch $39_j$ (j=0, . . . , 9, A, . . . , F) belongs to the analog multiplexer $37_1$, the voltage is supplied to the signal line SEG1.

As described above, the segment electrode driving circuit 30A in the first preferred embodiment is also designed to transmit the same signal as that of the segment electrode driving circuit described in the prior art, to the corresponding segment electrodes via the signal lines SEG1, . . . , SEGn.

However, the number of elements (transistors) of the segment electrode driving circuit 30A in the first preferred embodiment can be far less than that in the conventional circuit. For example, the number of elements of the decoder 38 in this preferred embodiment is 176, whereas the number of elements of the arithmetic circuit $90_i$ shown in FIG. 15, so that the number of elements is reduced by 64 (=230−176) for each segment electrode.

Thus, the liquid crystal display system in this preferred embodiment can have a smaller chip size than those in conventional liquid crystal display systems, and can prevent the yields of products from deteriorating, so that it is possible to reduce the manufacturing costs in comparison with the conventional liquid crystal display systems.

While the number k of scanning lines simultaneously selected in the liquid crystal display system in the first preferred embodiment has been 4, the present invention may be applied to the case where k=2 or k=3. Furthermore, when k=3, the number of data outputted from the data table 31 is 8 ($=2^3$), and when k=2, the number of data outputted from the data table 31 is 4 ($=2^2$), so that the number of the switching parts $35_i$ and the number of output signals of each of the decoders 38 can be less than the case where k=4.

However, when k>4, e.g., when the first preferred embodiment is applied to the case where k=8, the number of data outputted from the data table 31 is 256 ($=2^8$), so that the number of the switching parts $35_i$ is also 256. Thus, 256 power supply lines must be connected to the respective signal lines SEGj (j=1, . . . , n), so that this is not put to practical use. Therefore, the second preferred embodiment of a liquid crystal display system according to the present invention, which can be put to practical use when k>4, will be described below.

Figure 5:
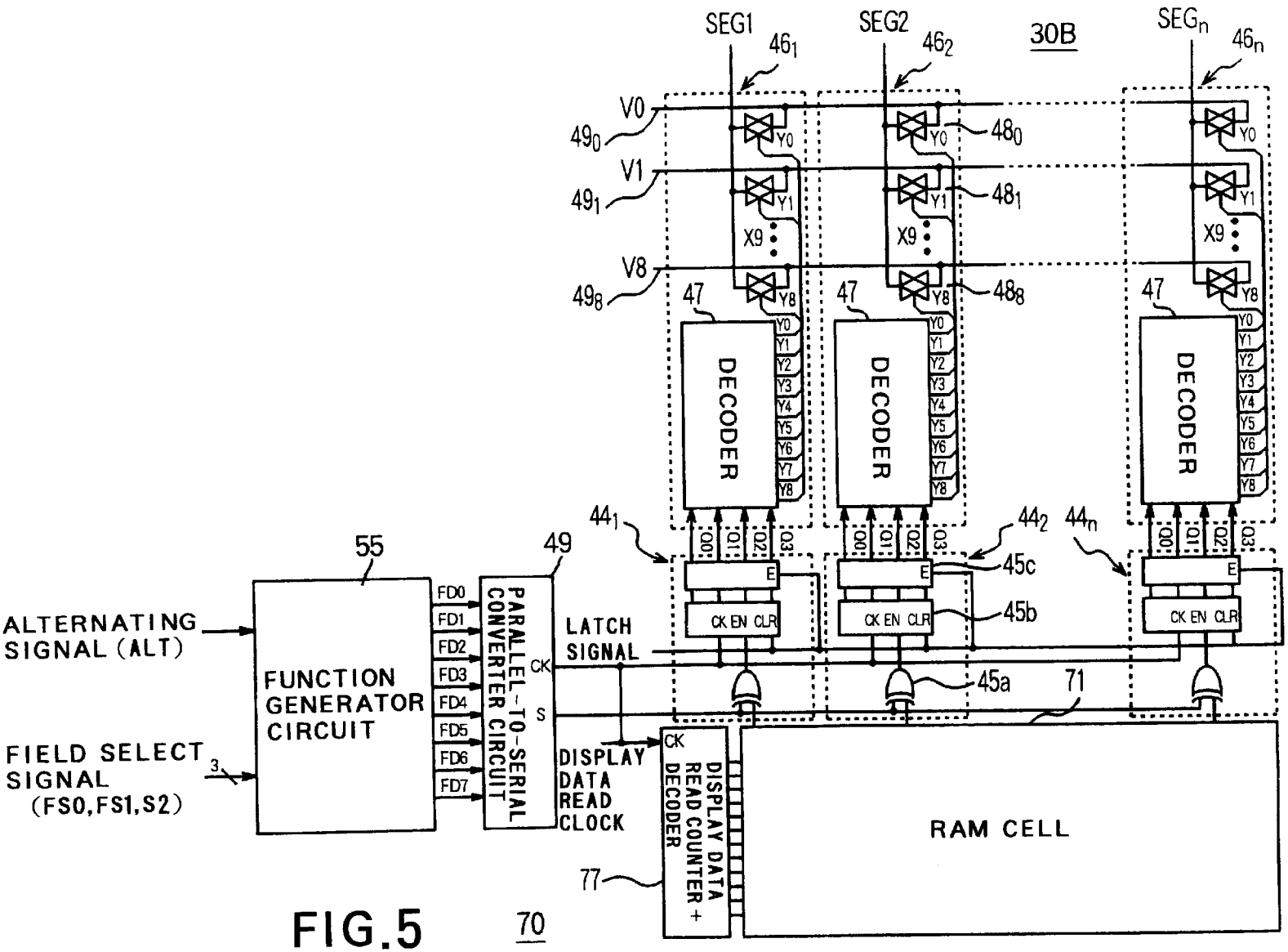
FIG. 5 is a block diagram of the second preferred embodiment of a segment electrode driving circuit according to the present invention.
Figure 18:
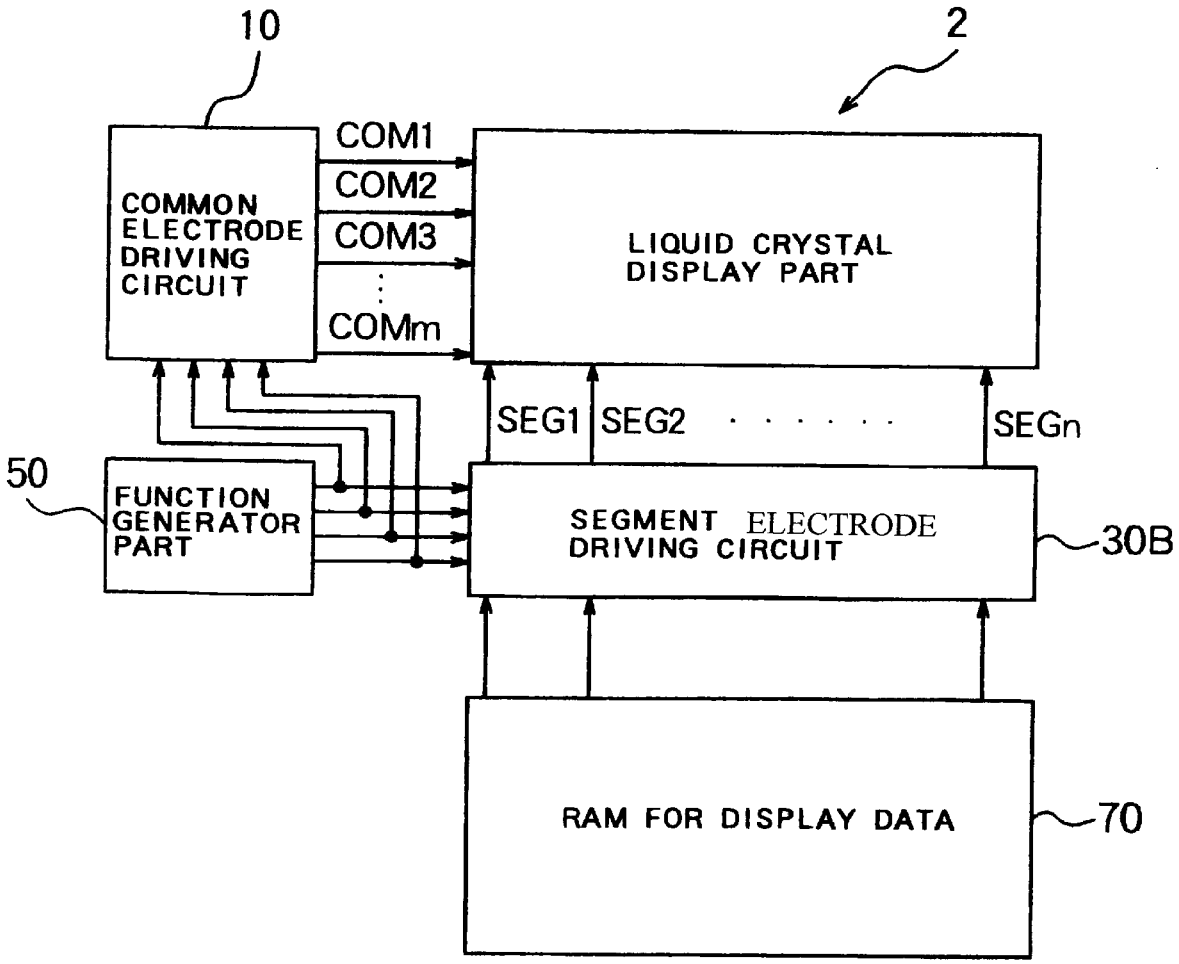
FIG. 18 is a block diagram of the second preferred embodiment of a liquid crystal display system according to the present invention.

FIGS. 5 and 18, the second preferred embodiment of a liquid crystal display system according to the present invention will be described below. FIG. 18 is a block diagram of the second preferred embodiment of a liquid crystal display system according to the present invention, and FIG. 5 is a block diagram of a segment electrode driving circuit 30B of the second preferred embodiment of a liquid crystal display system according to the present invention.

In the liquid crystal display system in the second preferred embodiment, the number of simultaneously selected scanning lines is k=8, and the segment electrode driving circuit 30B shown in FIG. 5 is substituted for the segment electrode driving circuit 30 of the conventional liquid crystal display system shown in FIG. 9.

The segment electrode driving circuit 30B comprises arithmetic circuits $44_1$, . . . , $44_n$, analog multiplexers $46_1$, . . . , $46_n$, and a parallel-to-serial converter circuit 49. The arithmetic circuits $44_i$ (i=1, . . . , n) correspond to signal lines SEGi, and each of the arithmetic circuits $44_i$ comprises an exclusive OR gate 45*a*, a 4-bit binary counter 45*b*, and a 4-bit latch circuit 45*c*. The analog multiplexers $46_i$ (i=1, . . . , n) correspond to the signal line SEGi, and each of the analog multiplexers $46_i$ comprises a decoder 47, and nine analog switches $48_0$, . . . , $48_8$.

The construction and operation of the segment electrode driving circuit 30B will be described below.

First, on the basis of an alternating signal ALT and 3-bit field select signals FS0, FS1 and FS2, eight function values FD0 through FD7 are outputted, in parallel, from a function generator circuit 55 to the parallel-to-serial converter circuit 49. The function values FD0 through FD7 are values of "0" or "1".

Then, the parallel-to-serial converter circuit 49 is operated on the basis of a display data read clock to serially output the function values FD0 through FD7 in synchronism with the clock one by one. on the other hand, a display data read counter 77 is operated on the basis of the display data read clock to serially output eight data DD0 through DD7, which are stored in a RAM cell 71 and each of which is 1-bit data, in synchronism with the clock.

In each of the arithmetic circuits $44_i$ (i=1, . . . , n), the exclusive OR gate 45*a* is designed to operate an exclusive OR on the basis of the function values FDj (j=0, . . . , 7), which are serially transmitted from the parallel-to-serial converter circuit 49, and the display data DDj which are transmitted from the RAM cell. The operated results are transmitted to the 4-bit binary counter 45*b* as an enable signal EN. When the value of the enable signal EN is "1", i.e., when the function value FDj is not coincident with the display data DDj, the binary counter 45*b* is designed to count up in synchronism with the leading edge of the display data read clock. Therefore, the counted value I represented by the following formula is operated.

$$I=DD0@FD0+DD1@FD1+\ldots+DD7@FD7$$

Furthermore, the symbol @ means an operation symbol indicative of an exclusive OR operation. The counted value I ($0 \leqq I \leqq 8$) is represented by 4-bit values Q3, Q2, Q1 and Q0 in the binary counter 45*b*. These 4-bit values are latched in the latch circuit 45*c* on the basis of a latch signal. At this time, the binary counter 45*b* is synchronously cleared by the latch signal. Furthermore, the binary counter 45*b* is designed so that the counted value is set to be 1 if the value of the enable signal EN is "1" when synchronously cleared.

In each of the analog multiplexers $46_i$ (i=1, . . . , n), the 4-bit values Q3, Q2, Q1 and Q0 latched in the latch circuit 45*c* are decoded by the decoder 47, and only one of nine signals Y0, Y1, . . . , Y8 is activated and outputted from the decoder 47. Assuming that $I=Q3\cdot 2^3+Q2\cdot 2^2+Q1\cdot 2+Q0$, only the signal YI is activated, i.e., YI="1". For example, when Q3=Q2=Q1=Q0="0", then I=0, so that the signal Y0 is activated.

If the signal YI (I=0, . . . , 8) is activated, the analog switch $48_I$ is turned ON, so that a signal line SEGi (i=1, . . . , n) is connected to the power supply line $49_I$. Since a voltage VI is supplied to the power supply line $49_I$, the voltage VI is supplied to a segment electrode connected to the signal line SEGi.

Figure 15:
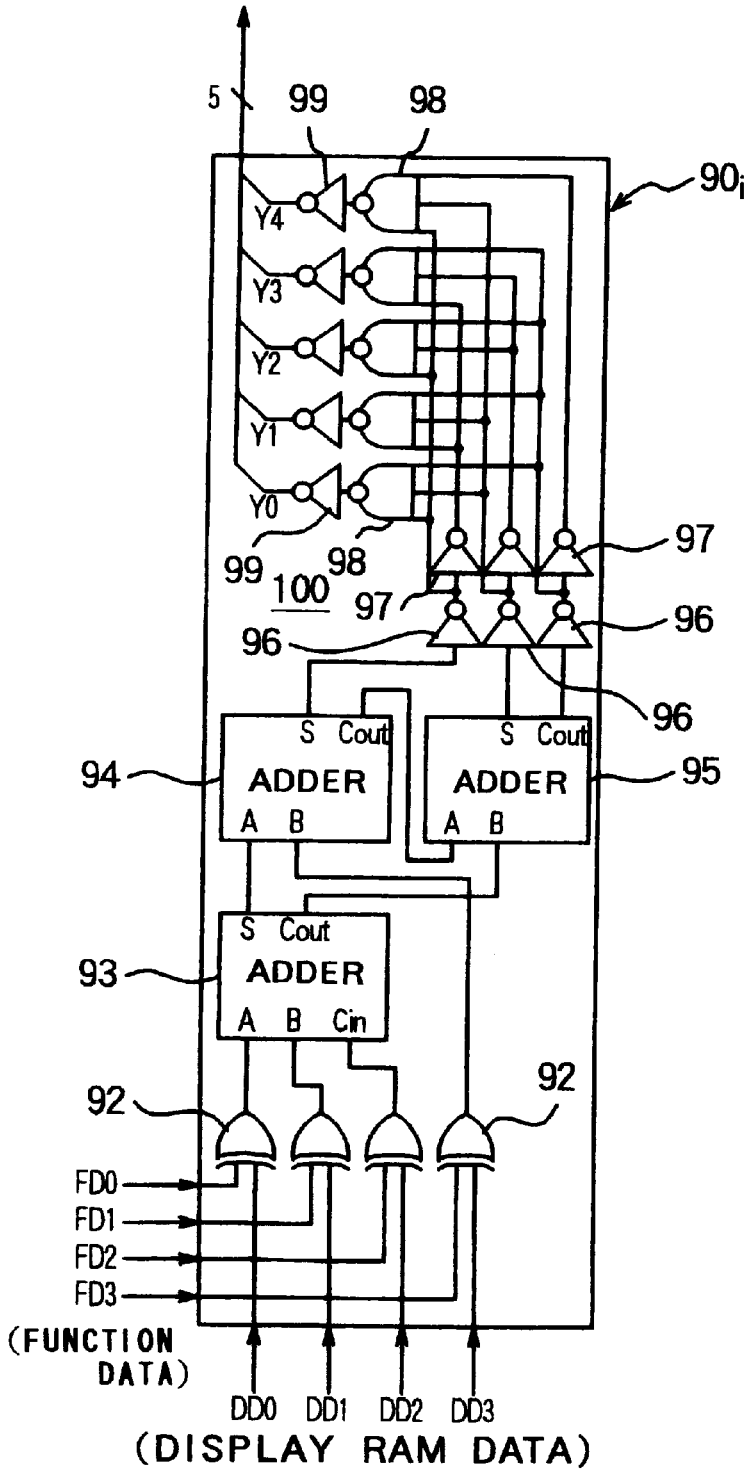
FIG. 15 PRIOR ART
FIG. 15 is a circuit diagram of an arithmetic circuit of the segment electrode driving circuit of FIG. 13.
Figure 16:
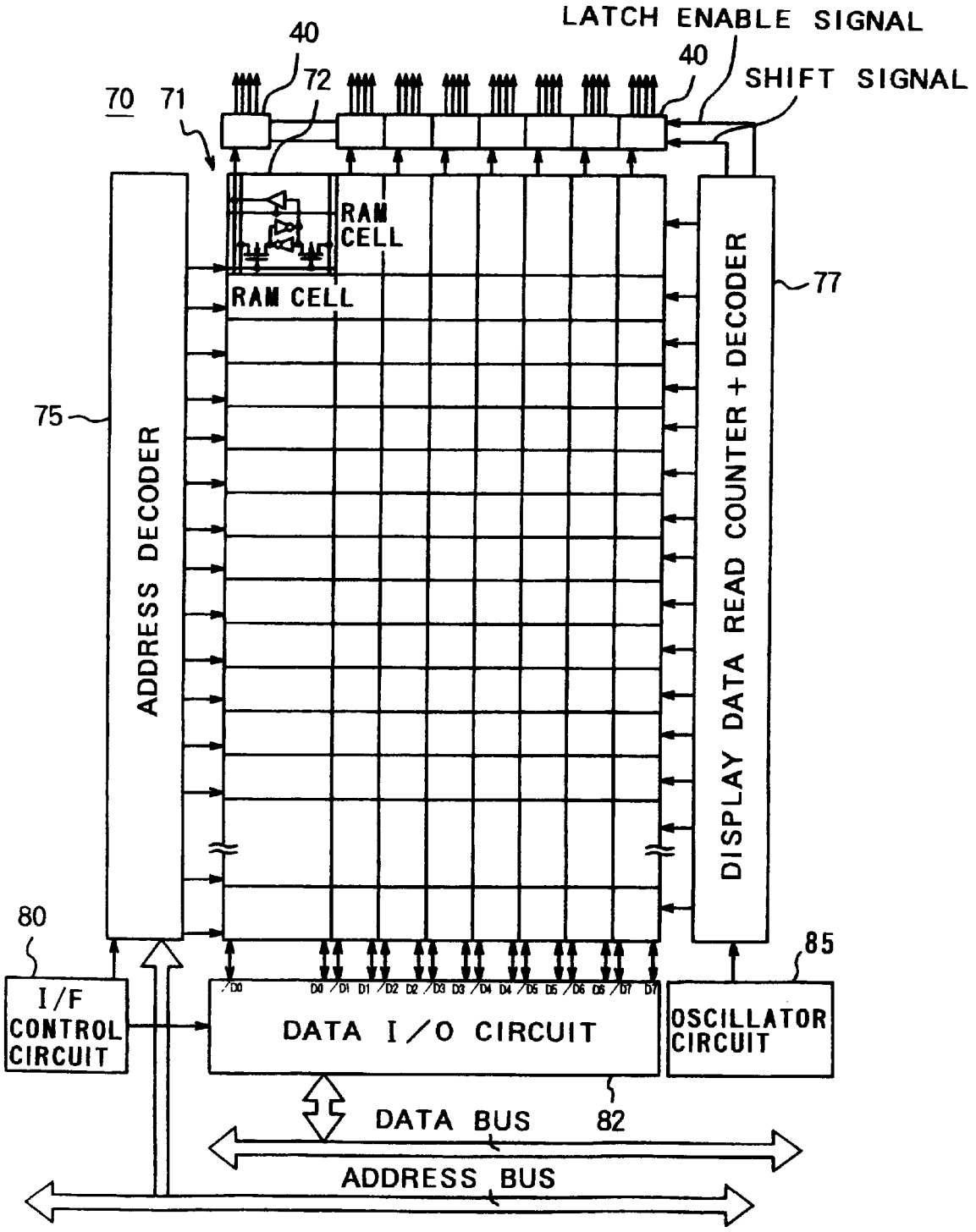
FIG. 16 PRIOR ART
FIG. 16 is a block diagram of a RAM for display data of a conventional liquid crystal display system.

As described above, according to this preferred embodiment, the exclusive OR gate 45*a* operates the function value FDj and the display data DDj one bit at a time, and the counter 45*b* counts up when the operated result is "1". Therefore, the same results as those in the conventional system wherein adders are used as shown in FIG. 15 can be obtained by a smaller circuit than that of the conventional system. Thus, the number of elements can be less than that in the conventional system. As a result, it is possible to prevent the chip size from increasing and it is possible to increase the yields, so that it is possible to prevent the manufacturing costs from increasing.

In addition, in the second preferred embodiment, the number of the power supply lines can be less than that in the first preferred embodiment. Therefore, the second preferred embodiment is very useful when the number k of simultaneously selected scanning lines exceeds 4.

Figure 6:
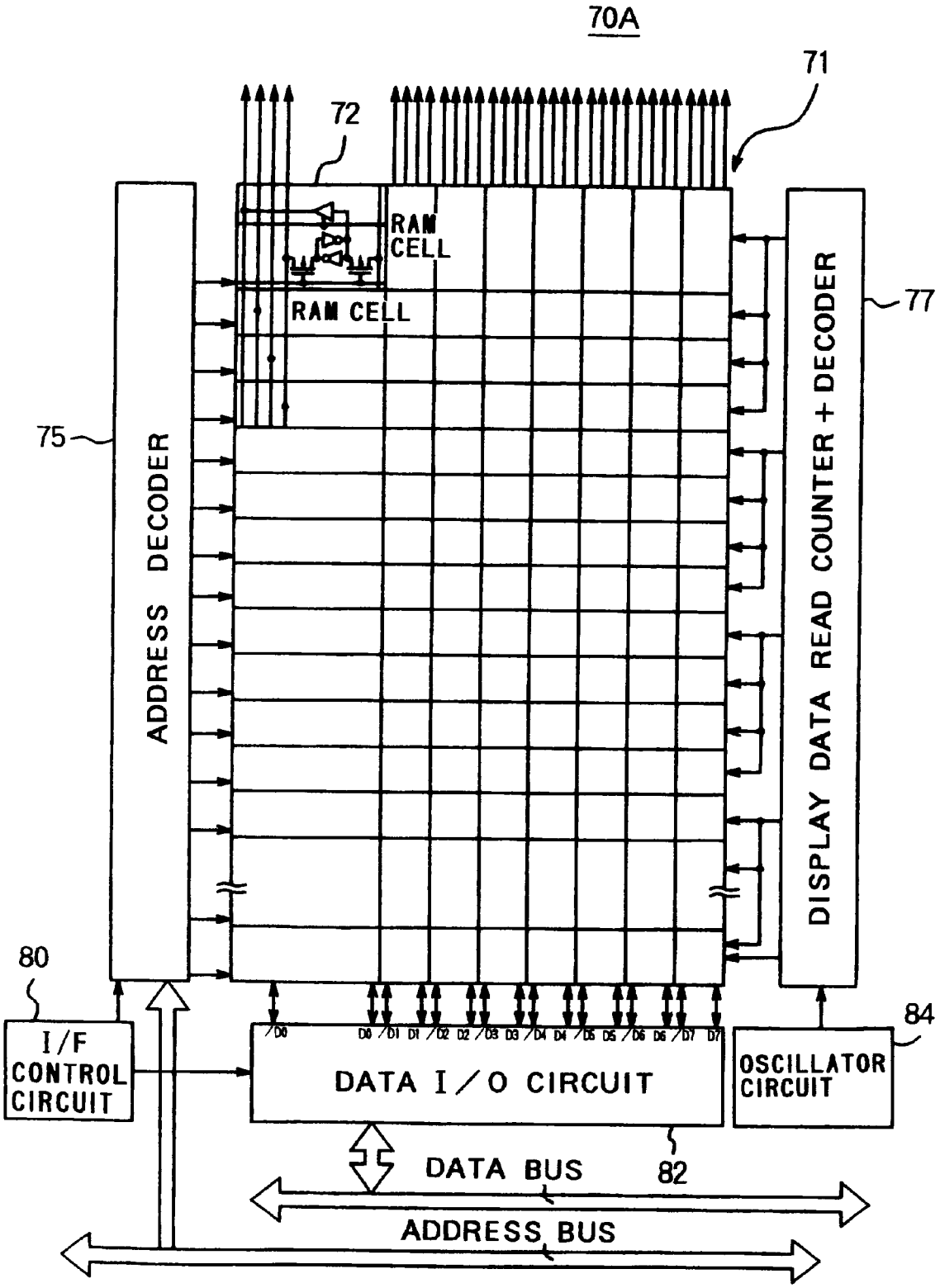
FIG. 6 is a block diagram showing the construction of a RAM for display data in the third preferred embodiment of the present invention.

Referring to FIG. 6, the third preferred embodiment of a liquid crystal display system according to the present invention will be described below.

FIG. 6 is a block diagram showing a RAM 70A for display data. In the liquid crystal display system in the third preferred embodiment, the RAM 70A for display data shown in FIG. 6 is substituted for the RAM for display data in the liquid crystal display system in the first preferred embodiment, and the outputs of the RAM 70A for display data are connected directly to DDi (i=0, . . . , 3) without the need of the latch circuits $\mathbf{40}_i$ (i=1, . . . , n) in the liquid crystal display system in the first preferred embodiment.

In the RAM 70A for display data, RAM cells 72 of the same column for transmitting display data to the same segment electrode have four output lines. When data are displayed, the RAM cells of successive four lines, which store therein data transmitted to pixels relating to simultaneously selected four scanning lines, are simultaneously selected by the display data counter 77.

The output of each of the simultaneously selected successive four RAM cells is connected to one of the four output lines, and different RAM cells are connected to different output lines. For example, assuming that the successive four RAM cells are first through fourth RAM cells and that the four output lines are first through fourth output lines, the outputs of the first through fourth RAM cells are connected to the first through fourth output lines, respectively.

In the third preferred embodiment, since the RAM cells for the successive four lines are simultaneously selected, the frequency of an oscillator circuit 84 may be one-fourth as high as that in the first preferred embodiment, so that it is possible to reduce electric power consumption in comparison with the first preferred embodiment.

Furthermore, according to the third preferred embodiment, it is possible to obtain the same advantages as those in the first preferred embodiment.

Figure 7:
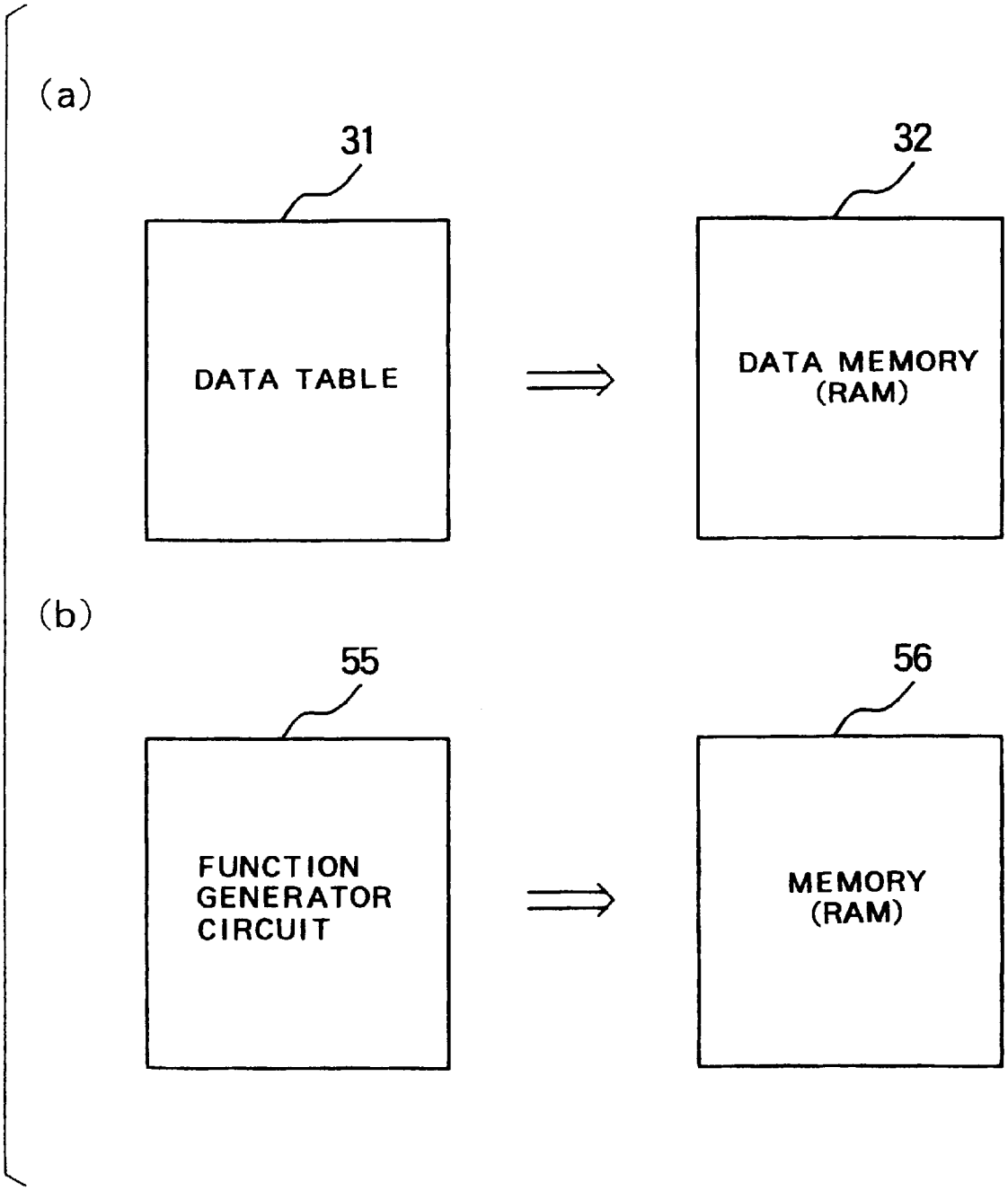
FIGS. 7(*a*) and 7(*b*) are schematic diagrams for explaining the fourth preferred embodiment of the present invention.

Referring to FIG. 7, the fourth preferred embodiment of a liquid crystal display system according to the present invention will be described below.

As shown in FIG. 7, in the liquid crystal display system in the fourth preferred embodiment, a data memory 32 of a RAM and a memory 56 of a RAM are substituted for the data table 31 and the function generator circuit 55, respectively, in the liquid crystal display system in the first preferred embodiment.

In the fourth preferred embodiment, since the data memory 32 of a RAM and the memory 56 of a RAM are used, it is possible to always use the optimum functions by replacing data stored in the memories.

Also according to the fourth preferred embodiment, it is possible to obtain the same advantages as those in the first preferred embodiment.

Figure 8:
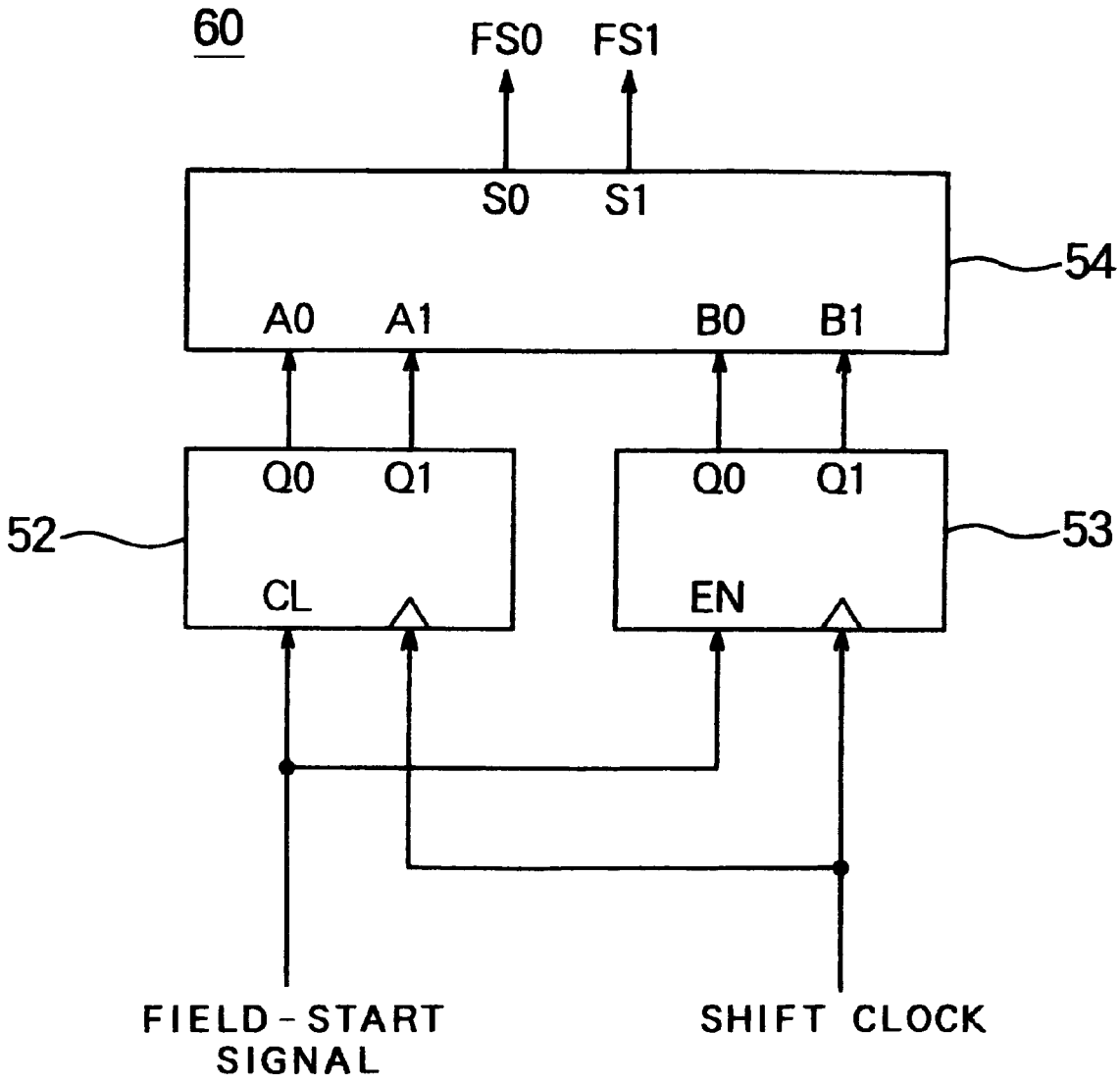
FIG. 8 is a circuit diagram showing the construction of a field changing system in the fifth preferred embodiment of the present invention.

Referring to FIG. 8, the fifth preferred embodiment of a liquid crystal display system according to the present invention will be described below.

Figure 10:
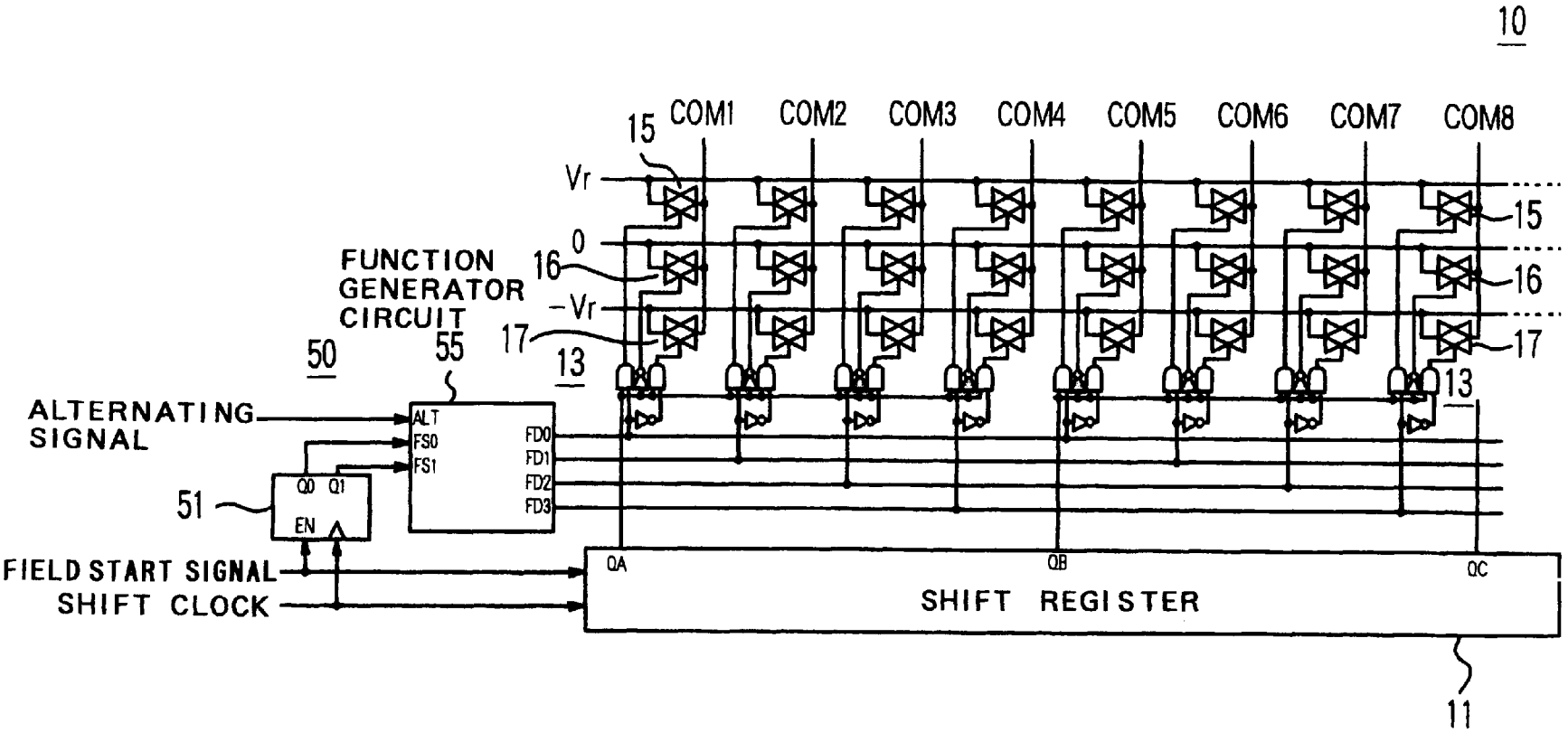
FIG. 10 PRIOR ART
FIG. 10 is a block diagram of a common electrode driving circuit of a conventional liquid crystal display system.
Figure 12:
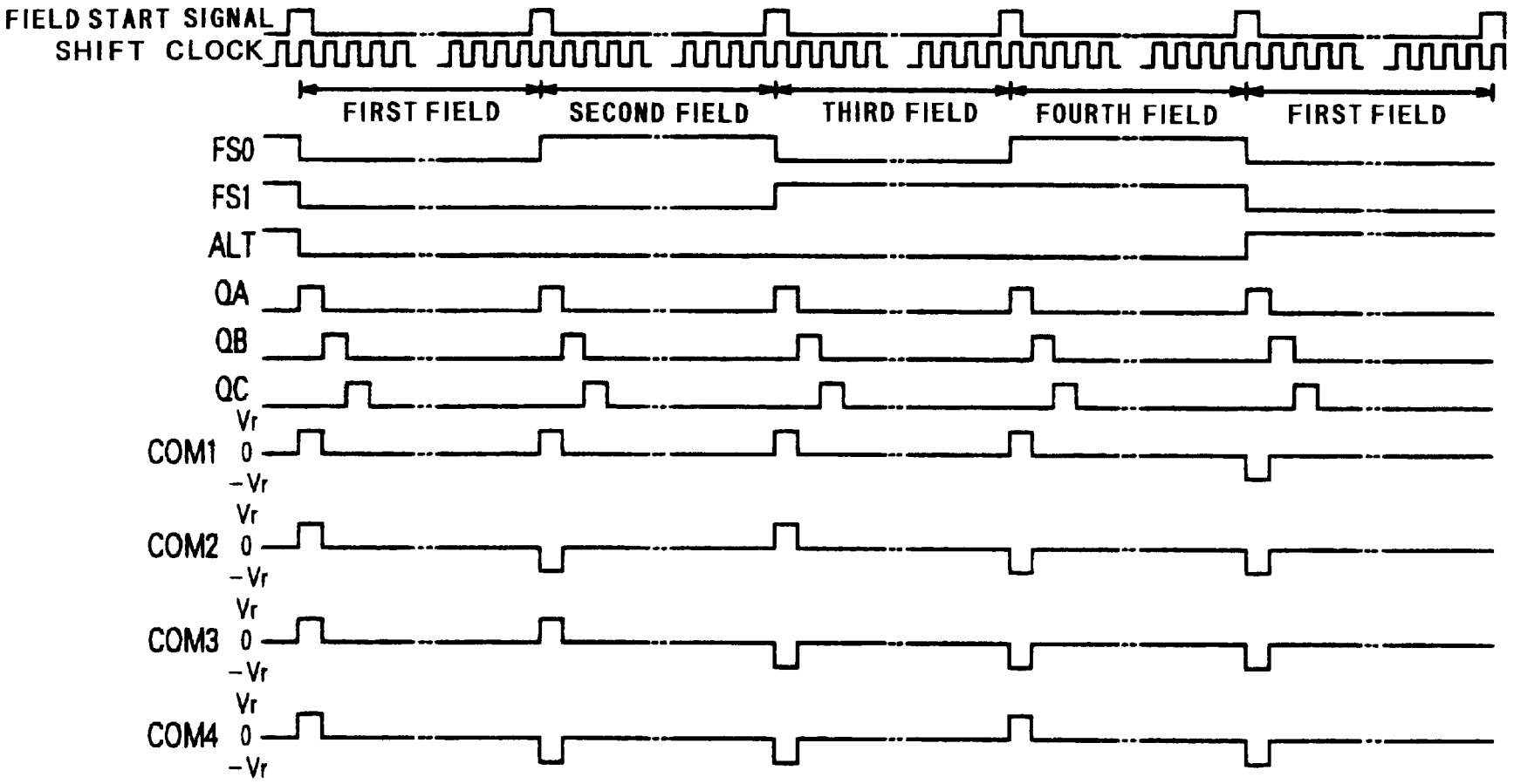
FIG. 12 PRIOR ART
FIG. 12 is a waveform illustration for explaining the operation of the common electrode driving circuit of FIG. 10.
Figure 13:
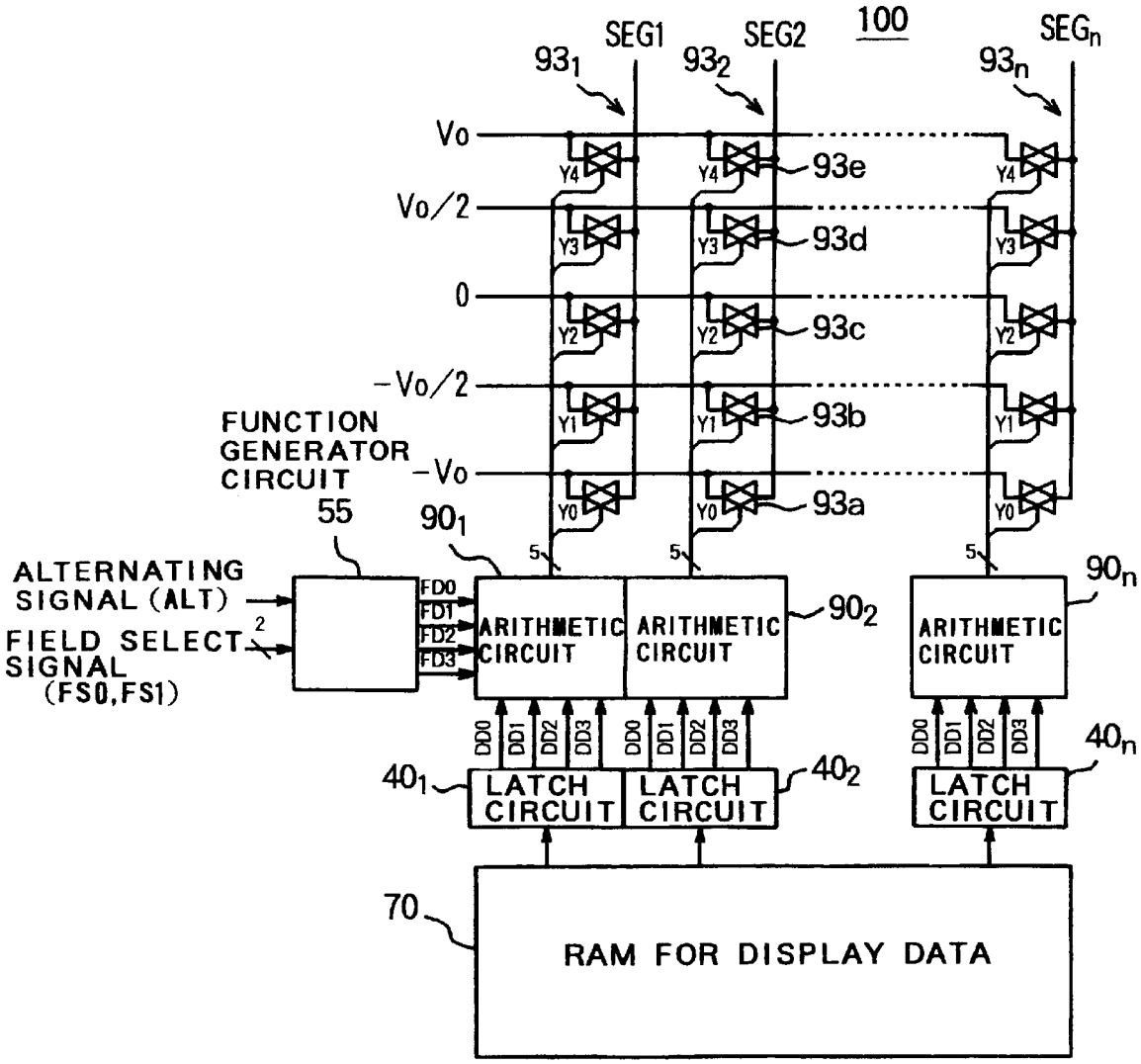
FIG. 13 PRIOR ART
FIG. 13 is a block diagram of a segment electrode driving circuit of a conventional liquid crystal display system.
Figure 14:
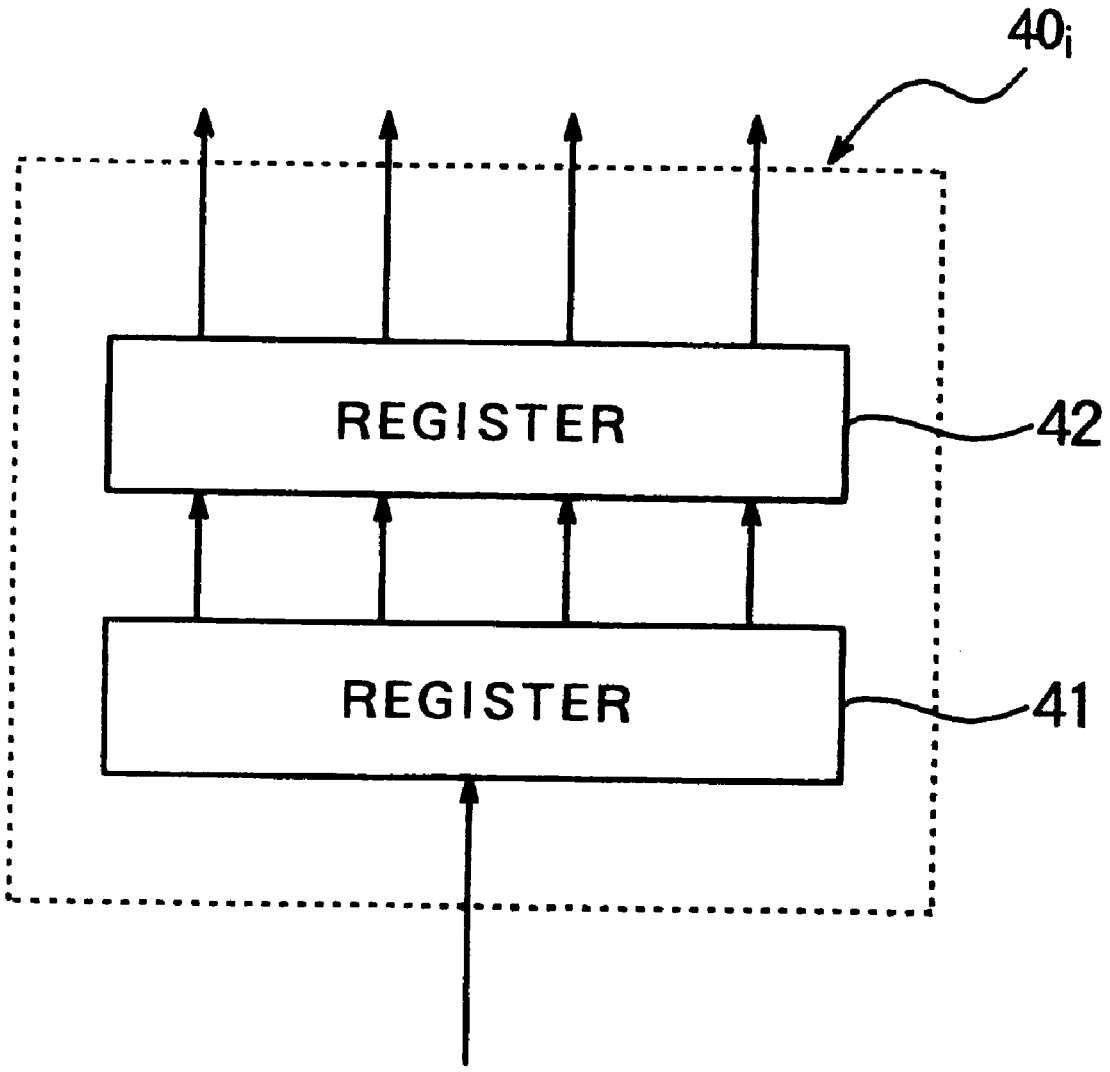
FIG. 14 PRIOR ART
FIG. 14 is a block diagram showing the details of a latch circuit of the segment electrode driving circuit of FIG. 13.

As shown in FIG. 8, in the liquid crystal display system in the fifth preferred embodiment, a field changing system 60 comprising two binary counters 52 and 53 and a 2-bit adder 54 is substituted for the binary counter 51 (see FIG. 10) in the liquid crystal display system in the fourth preferred embodiment. The field changing system 60 is designed to change the field of a scanning signal every time simultaneously selected four scanning lines are shifted.

Thus, it is possible to uniform a common electrode driving waveform in comparison with the fourth preferred embodiment.

Also according to the fifth preferred embodiment, it is possible to obtain the same advantages as those in the first preferred embodiment.

As described above, according to the present invention, it is possible to reduce the number of elements in comparison with conventional systems, and it is possible to prevent the chip size from increasing and the yields from decreasing, so that it is possible to the manufacturing costs from increasing.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A liquid crystal driving circuit comprising:

a function generating part for generating k (≧2) kinds of function values for k fields on the basis of a field start signal, a shift clock and an alternating signal;

a common electrode driving circuit for simultaneously selecting k common electrodes on the basis of said field start signal and said shift clock and for applying a plurality of kinds of common voltages to the selected k common electrodes;

a RAM for display data, in which data to be displayed on a liquid display part are stored; and a segment electrode driving circuit including:

data storing means for storing therein k+1 values in accordance with said k function values and $2^k$ k-bit data and for simultaneously outputting $2^k$ values on the basis of said alternating signal and a field select signal;

$2^k$ power supply lines provided so as to correspond to $2^k$ outputs of said data storing means;

a first analog multiplexer for connecting each of said $2^k$ power supply lines to one of k+1 power supplies, each of which has a potential different from each other, on the basis of a corresponding one of said $2^k$ outputs of said data storing means corresponding to a corresponding one of said $2^k$ power supply lines; and a second analog multiplexer, provided for each of segment electrodes, for receiving k display data corresponding to said selected k common electrodes from said RAM for display data, and for selecting one of said $2^k$ power supply lines on the basis of said k display data to connect the selected one of said $2^k$ power supply lines to a corresponding one of said segment electrodes.

2. A liquid crystal driving circuit as set forth in claim 1, wherein said first analog multiplexer comprises: a decoder circuit for decoding each of said $2^k$ outputs of said data storing means; and a switching part, provided for each of outputs of said decoder circuits, for connecting a corresponding one of said $2^k$ power supply lines to one of said k+1 power supplies on the basis of a corresponding one of said $2^k$ outputs of said data storing means.

3. A liquid crystal driving circuit as set forth in claim 1, wherein said second analog multiplexer comprises: decoder means for decoding said k display data received from said RAM for display data, as k-bit data; and a switching part for selecting one of said $2^k$ power supply lines on the basis of an output of said decoder means to connect the selected one of said $2^k$ power supply lines to a corresponding one of said segment electrodes.

4. A liquid crystal driving circuit as set forth in claim 1, wherein said data storing means is a data table.

5. A liquid crystal driving circuit as set forth in claim 1, wherein said data storing means has a first RAM, and said function generating part has a second RAM, in which said function values are stored.

6. A liquid crystal driving circuit as set forth in claim 5, wherein said common electrode driving circuit is operated so as to sequentially shift said simultaneously selected k common electrodes, and said function generating part further comprises field changing means for changing a field of a generated function every time said simultaneously selected k common electrodes are shifted.

7. A liquid crystal driving circuit as set forth in claim 1, wherein said RAM for display data serially outputs k display data which are to be transmitted to each of said segment electrodes, and wherein said segment electrode driving circuit further comprises latch circuits, each of which is provided for each of said segment electrodes and each of which comprises a first register for serially receiving k display data, which are to be transmitted to a corresponding one of said segment electrodes, from said RAM for display data, and a second register for receiving and latching, in parallel, said k display data, which are stored in said first register, to supply the latched display data to said second analog multiplexer.

8. A liquid crystal driving circuit as set forth in claim 1, wherein said RAM for display data outputs, in parallel, k display data, which are to be transmitted to each of said segment electrodes, and wherein said segment electrode driving circuit further comprises latch circuits, each of which is provided for each of said segment electrodes for latching k display data which are read out of said RAM for display data in parallel.

9. A liquid crystal driving circuit comprising:

a function generating part for generating k ($\geqq 2$) kinds of function values for k fields on the basis of a field start signal, a shift clock and an alternating signal;

a common electrode driving circuit for simultaneously selecting k common electrodes on the basis of said field start signal and said shift clock and for applying a plurality of kinds of common voltages to the selected k common electrodes;

a RAM for display data, in which data to be displayed on a liquid display part are stored;

an arithmetic circuit including: k+1 power supply lines, to each of which a voltage different from each other is supplied; and a counter circuit, provided for each of segment electrodes, for receiving k display data corresponding to said k common electrodes, one by one, in synchronism with a predetermined clock and for receiving said k function values outputted from said function generating part, one by one, in synchronism with said predetermined clock to be operated in accordance with an exclusive OR of said k display data and said k function values in synchronism with said predetermined clock; and a segment electrode driving circuit having an analog multiplexer, provided for each of said segment electrodes, for selecting one of said k+1 power supply lines on the basis of an output of said arithmetic circuit and for connecting the selected one of said k+1 power supply lines to a corresponding one of said segment electrodes.

10. A liquid crystal driving circuit as set forth in claim 9, wherein said analog multiplexer comprises: decoder means for decoding a value received from said arithmetic circuit; and a switching part for selecting one of said power supply lines on the basis of an output of said decoder means to connect the selected one of said power supply lines to a corresponding one of said segment electrodes.

11. A liquid crystal display system comprising:

a liquid crystal display part comprising a first transparent substrate, on which a plurality of common electrodes are arranged in parallel to each other, a second transparent substrate, on which a plurality of segment electrodes are arranged in parallel to each other, said second transparent substrate facing said first transparent substrate so that said common electrodes intersect said segment electrodes, and a liquid crystal layer sandwiched between said first and second transparent substrate;

a function generating part for generating k ($\geqq 2$) kinds of function values for k fields on the basis of a field start signal, a shift clock and an alternating signal;

a common electrode driving circuit for simultaneously selecting k common electrodes on the basis of said field start signal and said shift clock and for applying a plurality of kinds of common voltages to the selected k common electrodes;

a RAM for display data, in which data to be displayed on a liquid display part are stored; and a segment electrode driving circuit including:

data storing means for storing therein k+1 values in accordance with said k function values and $2^k$ k-bit data and for simultaneously outputting $2^k$ values on the basis of said alternating signal and a field select signal;

$2^k$ power supply lines provided so as to correspond to $2^k$ outputs of said data storing means;

a first analog multiplexer for connecting each of said $2^k$ power supply lines to one of k+1 power supplies, each of which has a potential different from each other, on the basis of a corresponding one of said $2^k$ outputs of said data storing means corresponding to a corresponding one of said $2^k$ power supply lines; and a second analog multiplexer, provided for each of segment electrodes, for receiving k display data corresponding to said selected k common electrodes from said RAM for display data, and for selecting one of said $2^k$ power supply lines on the basis of said k display data to connect the selected one of said $2^k$ power supply lines to a corresponding one of said segment electrodes.

12. A liquid crystal display system comprising:

a liquid crystal display part comprising a first transparent substrate, on which a plurality of common electrodes are arranged in parallel to each other, a second transparent substrate, on which a plurality of segment electrodes are arranged in parallel to each other, said second transparent substrate facing said first transparent substrate so that said common electrodes intersect said segment electrodes, and a liquid crystal layer sandwiched between said first and second transparent substrate;

a function generating part for generating k (≧2) kinds of function values for k fields on the basis of a field start signal, a shift clock and an alternating signal;

a common electrode driving circuit for simultaneously selecting k common electrodes on the basis of said field start signal and said shift clock and for applying a plurality of kinds of common voltages to the selected k common electrodes;

a RAM for display data, in which data to be displayed on a liquid display part are stored;

an arithmetic circuit including: k+1 power supply lines, to each of which a voltage different from each other is supplied; and a counter circuit, provided for each of segment electrodes, for receiving k display data corresponding to said k common electrodes, one by one, in synchronism with a predetermined clock and for receiving said k function values outputted from said function generating part, one by one, in synchronism with said predetermined clock to be operated in accordance with an exclusive OR of said k display data and said k function values in synchronism with said predetermined clock; and a segment electrode driving circuit having an analog multiplexer, provided for each of said segment electrodes, for selecting one of said k+1 power supply lines on the basis of an output of said arithmetic circuit and for connecting the selected one of said k+1 power supply lines to a corresponding one of said segment electrodes.

* * * * *